US006843814B1

(12) United States Patent
Schingnitz et al.

(10) Patent No.: US 6,843,814 B1
(45) Date of Patent: Jan. 18, 2005

(54) METHOD AND APPARATUS FOR THE GASIFICATION OF FUELS, RESIDUES AND WASTE WITH PREEVAPORATION

(75) Inventors: Manfred Schingnitz, Freiberg (DE); Dietmar Adler, Siebenlehn (DE); Manfred Windmüller, Freiberg (DE)

(73) Assignee: Noell-KRC Energie-und Umwelttechnik GmbH, Schkeuditz (DE)

( * ) Notice: Subject to any disclaimer, the term of this patent is extended or adjusted under 35 U.S.C. 154(b) by 776 days.

(21) Appl. No.: 09/707,055

(22) Filed: Nov. 6, 2000

(30) Foreign Application Priority Data

Nov. 6, 1999 (DE) ..... 199 53 491

(51) Int. Cl.[7] ..... C10J 1/00; C10B 57/00

(52) U.S. Cl. ..... 48/107; 48/212; 422/198

(58) Field of Search ..... 48/211, 212, 214, 48/215, 197 FM, 75, 94, 95, 102 R, 102 A, 107; 422/188, 189, 191, 193, 198

(56) References Cited

U.S. PATENT DOCUMENTS 3,970,524 A * 7/1976 Funk ..... 201/2.5
4,078,989 A * 3/1978 Leas ..... 208/414
4,152,122 A * 5/1979 Feldmann ..... 48/111
4,950,309 A 8/1990 Schulz
5,104,419 A * 4/1992 Funk ..... 48/209
5,134,944 A * 8/1992 Keller et al. ..... 110/234
5,273,556 A * 12/1993 McMahon et al. ..... 48/197 R
5,347,068 A 9/1994 Rabe et al.
5,449,854 A 9/1995 Yap

FOREIGN PATENT DOCUMENTS

| | | |
|---|---|---|
| DE | 41 09 231 | 9/1992 |
| DE | 43 28 188 | 2/1995 |
| DE | 44 46 803 | 6/1998 |

* cited by examiner

*Primary Examiner*—Samuel M. Heinrich
(74) *Attorney, Agent, or Firm*—Cohen, Pontani, Lieberman & Pavane

(57) ABSTRACT

A method and apparatus are described for utilizing fuels, residues and waste by gasification in a free-flowing stream under normal or increased pressure at temperatures higher than 900° C., preferably between 1100 and 1600° C., with a gasifying medium containing free oxygen, in which the fuels, residues and waste are completely vaporized by the direct or indirect supply of heat and then fed in vapor form to a gasification reactor.

14 Claims, 4 Drawing Sheets

METHOD AND APPARATUS FOR THE GASIFICATION OF FUELS, RESIDUES AND WASTE WITH PREEVAPORATION

BACKGROUND OF THE INVENTION

1. Field of the Invention

The invention relates to a method for utilizing vaporizable liquid fuels, residues and waste by gasification to recover in post gasification processing, useful products from a gasified form of the fuels residues and wastes, as well as apparatus for carrying out the method for the gasification of fuels, residues and waste which are completely vaporized before being fed to the gasification process.

By fuels, residues and waste are meant, herein as including, hydrocarbons such as gasolines and fuel oils, halogen-containing or nitrogen-containing hydrocarbons from industry or contaminated solvents or mixtures.

2. Description of the Related Art

It is known, and is the state of the art, in the gasification of liquid fuels, residues and waste in a free-flowing stream, to feed these in the liquid state to the gasification reactor via a burner and to divide them into fine droplets by pressure atomization or by an atomizing medium. (Kohlenvergasung, Brennstoffwirtschaft International [Coal Gasification, Fuel Economy International], number 4, Verlag Glückauf GmbH, Essen 1979). The flame geometry, the carbon conversion degree and the conversion rate are determined critically by the drop size. At the same time, the gasification conditions are selected, with reference to the gasification temperatures, the gasification pressure and the composition of the gasifying medium, namely industrial oxygen and water vapor, in such a way that the formation of soot is ruled out thermodynamically. It is shown in practice, however, that 1 to 4% of the carbon contained in the gasification material occurs, ungasified, in the form of soot and has to be removed from the crude gas in the purification processes which follow gasification. This toxic soot is treated at considerable outlay and is returned for gasification. In the reclamation of useful materials, for example of halogen hydracids in the gasification of halogen-containing residues and waste, the soot which occurs is detrimental to the quality of this useful material and requires additional technological measures for purification.

U.S. Pat. No. 4,950,309 discloses a method for utilizing fuels, residues and waste by gasification in the free flow with a gasifying medium containing free oxygen, in which the gasification materials mentioned, in contrast to the proposed method, are not present as a homogeneous liquid phase but rather as a slurry in the form of a heterogeneous solid-liquid two-phase system. By way of the prior heating the liquid portions are completely or partially vaporized and fed as a steam-solid mixture to the gasification reactor. The purpose of the partial or complete vaporization of the liquid portions is primarily to feed the solids already in the dry state to the gasification reactor in order not to impede the gasification process with an upstream drying process. With that however only a process with which a heterogeneous gas-solid two-phase system is produced, is disclosed.

SUMMARY OF THE INVENTION

The object on which the invention is based is to utilize gasification on the principle of partial oxidation in a free-flowing stream for vaporizable fuels, residues and waste for the production of a gas of versatile use, rich in carbon monoxide and in hydrogen, and of useful materials, and, at the same time, to prevent or substantially restrict the formation of soot.

The method according to the invention and the apparatus according to the invention start from the assumption that the fuel, residue and waste intended for gasification in a free-flow reactor is first completely vaporized and is fed in vapor form to the gasification chamber, in which reaction with the gasifying medium takes place under normal or increased pressure at temperatures at least higher than about 900° C., preferably between 1100° C. and 1600° C.

It is advantageous, in this case, that the complete vaporization of the fuels, residues and waste is carried out by means of steam which is fed to the gasification reactor together with the completely vaporized fuel, residue and waste.

It is possible for the fuels, residues and waste to be completely vaporized at a high flow rate in a Venturi tube as prevaporizer, with steam being supplied, and fed to the gasification reactor.

Another possibility consists in the fact that the fuel, residues and waste are administered together with the steam to a prevaporization chamber and the completely vaporized gasification materials are reacted in the gasification reactor, with the gasifying medium being supplied.

Furthermore, it is possible for the fuels, residues and waste to be vaporized by indirect heating in a heat exchanger and administered in vapor form to the gasification reactor.

For carrying out the method, it is possible to provide a prevaporization chamber with a feed for steam and with a feed for fuels, residues and waste.

In this case the fuel, residue and waste which was completely vaporized in a prevaporization chamber, with steam being supplied, is fed to the gasification reactor via an annular gap and the gasifying medium is conducted to the burner mouth via a central tube.

For carrying out the method, the prevaporization chamber can be integrated into the gasification reactor shell and contain feeds for fuels, residues and waste and also feeds for steam and the completely vaporized gasification materials are reacted in a first following gasifying chamber, with the gasifying medium being supplied.

For carrying out the method, a prevaporization chamber can be provided as a heated heat exchanger in front of the gasification burner.

For carrying out the method, a Venturi tube can be provided as the prevaporizer, along with a feed for steam and a feed for the fuels, residues and waste preceding the gasification burner.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
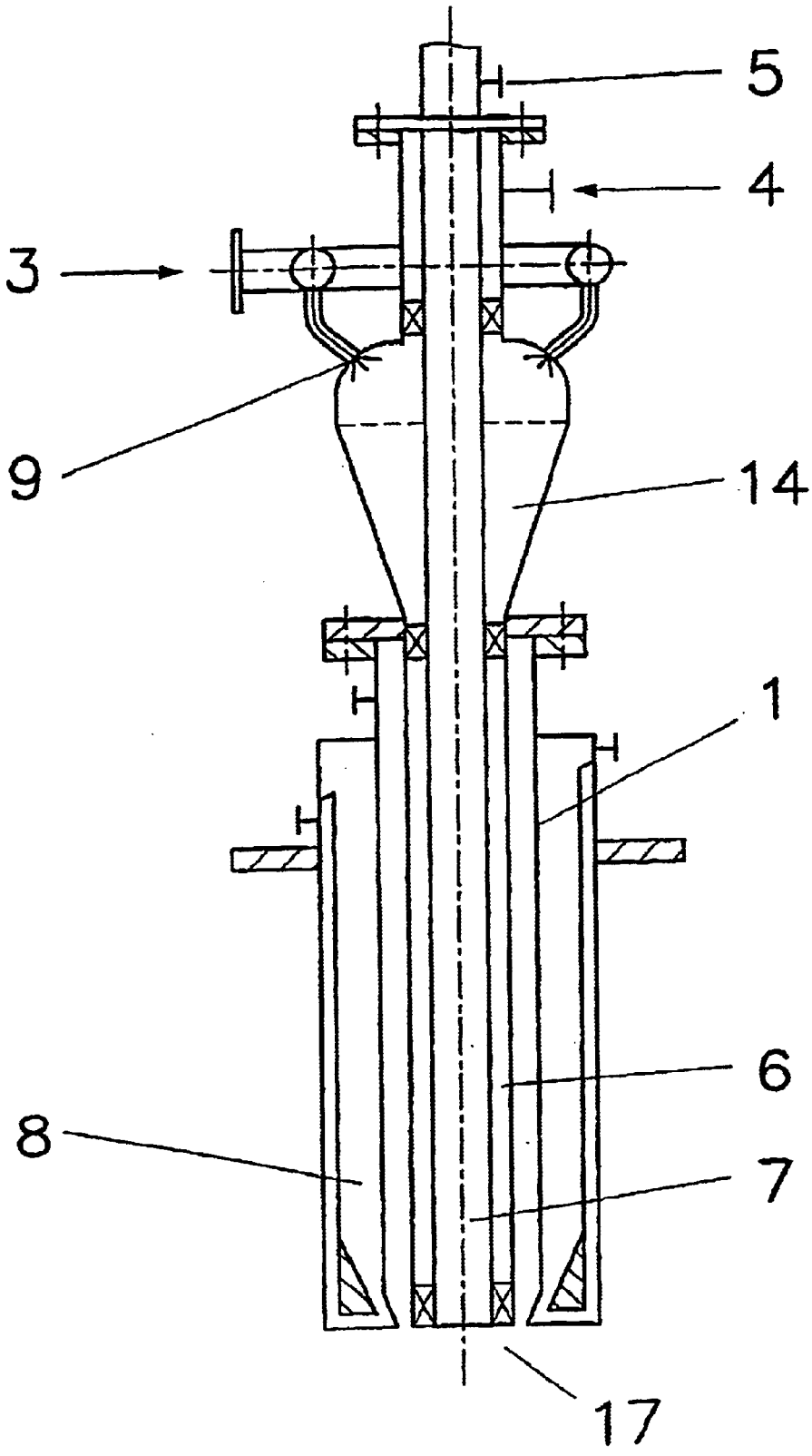
FIG. 1 shows a gasification burner with a prevaporization chamber.

FIG. 1 shows a gasification burner 1 with a prevaporization chamber 14. The liquid fuel, residue and waste to be gasified is administered via the feed 3 to the prevaporization chamber 14, into which steam is injected via the connection piece 4. The perceptible heat of the steam is utilized for completely vaporizing the fuel, residue and waste. The vaporized gasification material passes, together with the steam supplied via the connection piece 4, through the annular gap 6 to the burner mouth 17, where intermixing and reaction with the gasifying medium supplied via the feed 5 and the central tube 7, said gasifying medium being air, oxygen-enriched air or industrial oxygen, can take place. Steam may additionally be administered to the gasifying medium. The metal parts of the gasification burner 1 are cooled by means of annular spaces 8 loaded with water. In order to achieve rapid vaporization, the gasification material is supplied in finely distributed distributed form via nozzles 9.

Figure 2:
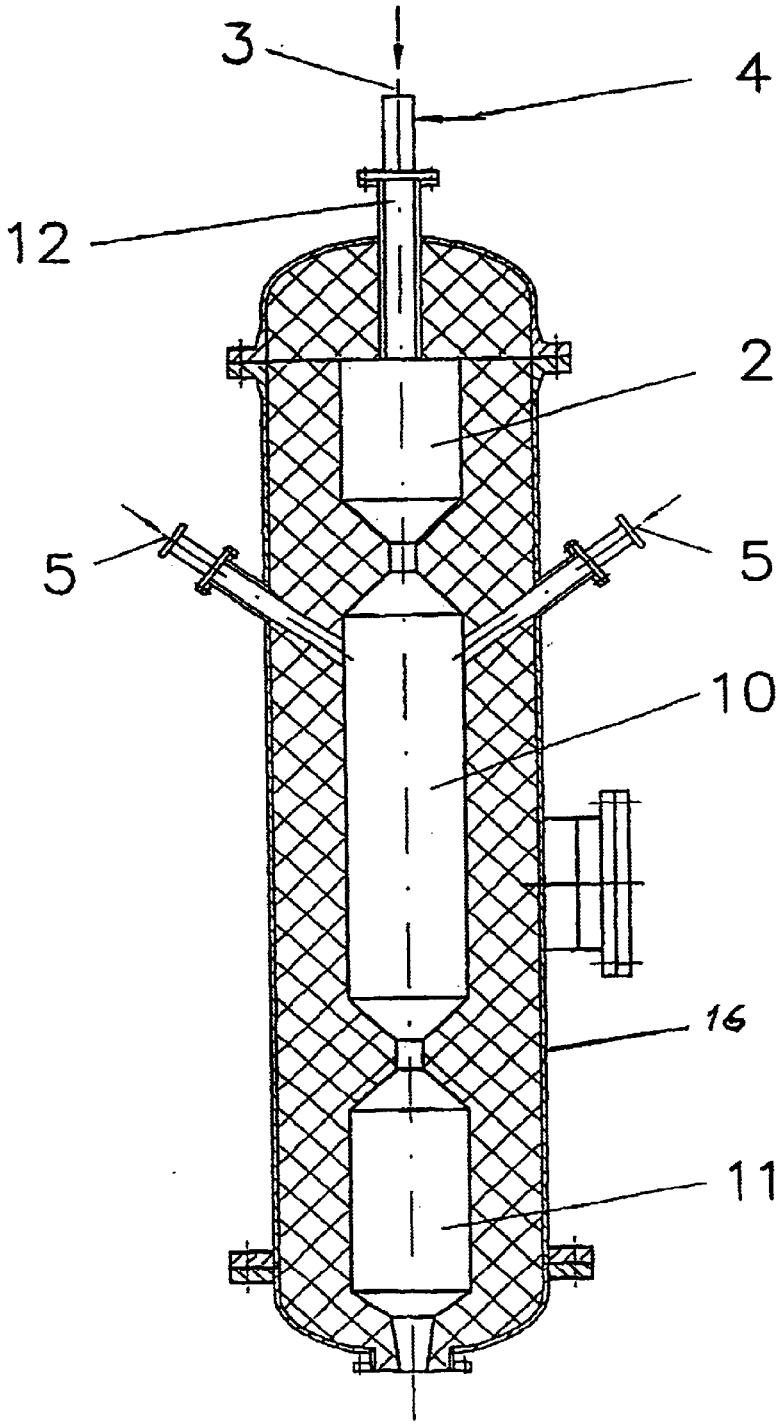
FIG. 2 shows a prevaporization chamber integrated into the gasification reactor shell.

FIG. 2 shows a solution variant in which the prevaporization chamber 2 is integrated into the gasification reactor shell 16. Gasification material and steam are administered to the prevaporization chamber 2 via feeds 3, 4 into a common tubular feed 12. The vaporized material flows into the first gasifying chamber 10, where the gasification reaction can take place as a result of the supply of gasifying medium 5. The exemplary embodiment shows a further, downstream gasifying chamber 11.

Figure 3:
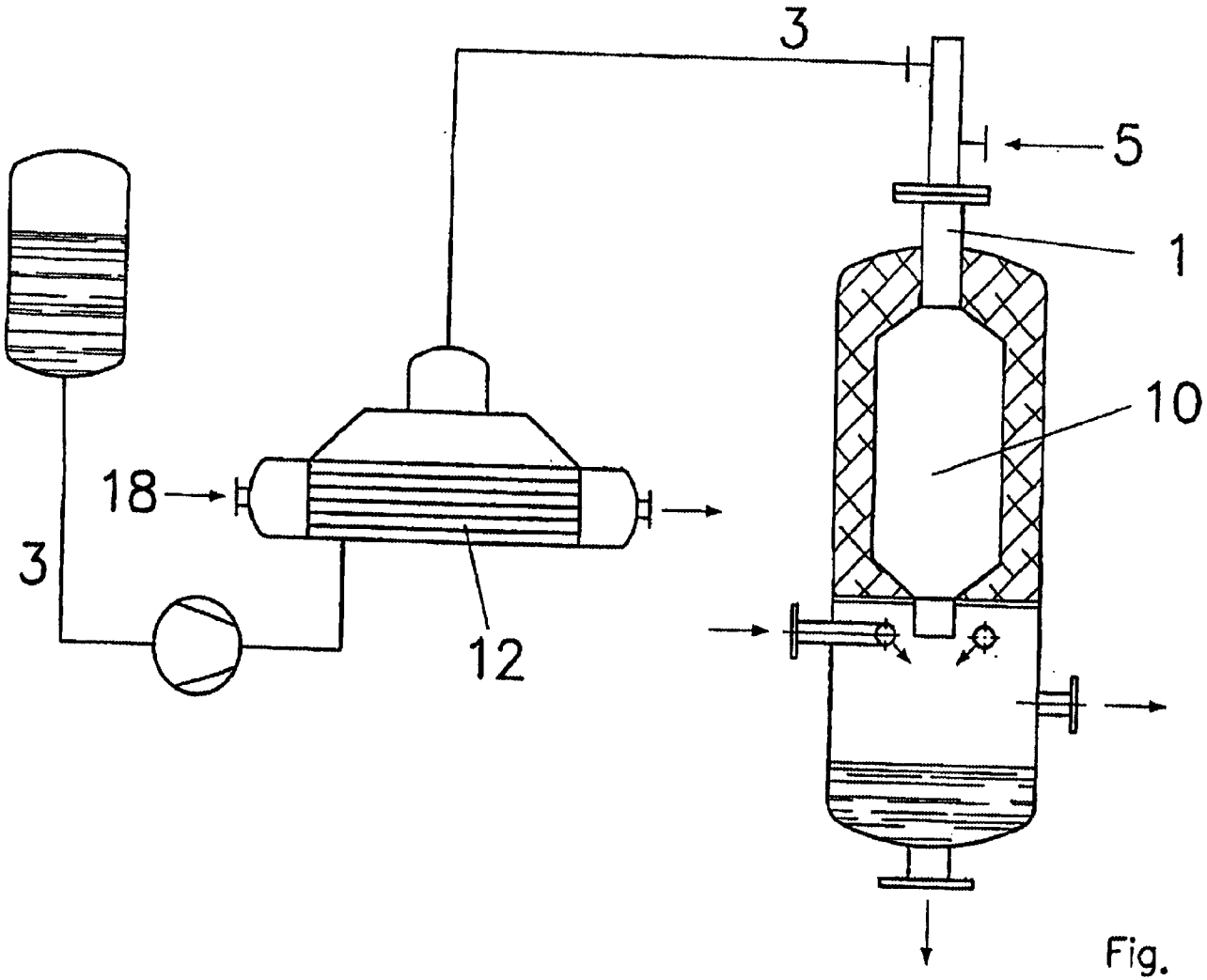
FIG. 3 shows a preceding vaporizer upstream of a gasifier.

FIG. 3 shows the possibility of prevaporization for low-boiling fuels, residues and waste. The gasification material supplied from a liquid fuel, residues and waste supply tank 38 is supplied to an inlet 36 of a heat exchanger 12 by way of line 3*a*. The liquid fuels, residues and wastes are completely vaporized by the indirect supply of heat, e.g., a feed of steam, into heat exchanger 12 through fitting 18. A line 3*b* connects an outlet 37 of the heat exchanger with an inlet 38 to gasification burner 1. The fuels, resides and waste are supplied in vapor form, along with the gasifying medium, to the gasifying chamber 10 via gasification burner 1.

Figure 4:
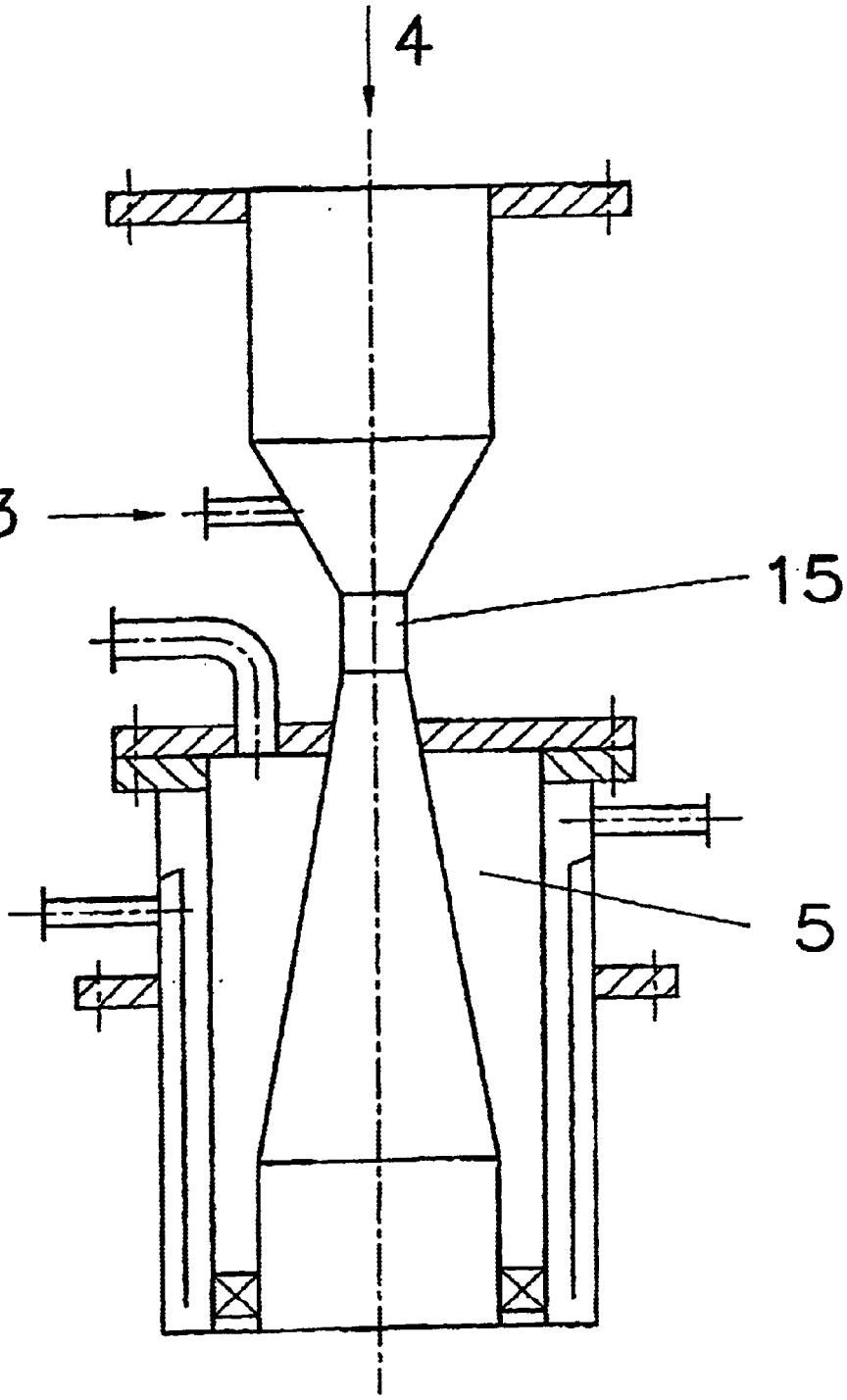
FIG. 4 shows a prevaporization chamber designed as a Venturi tube.

FIG. 4 shows the design of the prevaporization chamber as a Venturi tube 15. The steam 4 necessary for completely vaporizing the gasification material flows into the Venturi tube 15, upstream of the narrowest cross section of the Venturi and of the location at which the gasification material 3 to be vaporized is introduced as at 3. Due to the high velocity of the steam stream, the gasification material is divided into fine droplets which are quickly and completely vaporized as a result of the high heat transmission rate.

Formation of soot is avoided by the complete prevaporization of the fuels, residues and waste, so that the subsequent purification of the gas becomes greatly simplified and thus cost-effective.

The invention is not limited by the embodiments described above which are presented as examples only but can be modified in various ways within the scope of protection defined by the appended patent claims.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A method for utilizing vaporizable liquid fuels, residues and waste by gasification of said fuels, residues and waste to recover in a post gasification processing, useful products from a gasified form of the fuels, residues and waste, comprising:

heating the fuels, residues and waste to completely vaporize said fuels, residues and waste to a vapor form; and reacting a feed of the vapor form of said fuels, residues and waste with a gasifying medium containing free oxygen in a gasification reaction zone at a temperature of at least about 900° C. to provide the gasified form of said fuels, residues and waste.

2. The method as claimed in claim 1 in which the fuels, residues and waste are reacted at a temperature in a range of about 1100° C. to about 1600° C.

3. The method as claimed in claim 1, in which the fuels, residues and waste are vaporized by directly contacting the fuels, residues and waste with a heated fluid, the heated fluid delivering the fuels, residues and waste to the gasification reaction.

4. The method as claimed in claim 3, in which the heated fluid is steam.

5. The method as claimed in claim 1, in which the fuels, residues and waste are vaporized in an indirect heat exchange operation with a heating medium and fed in gaseous form to the reaction zone.

6. The method as claimed in claim 1, in which the fuels, residues and waste are vaporized by passing a feed of the fuels, residues and wastes in company with a feed of steam through a venturi tube.

7. The method as claimed 6, in which the fuels, residues and waste are introduced into the venturi tube at a location upstream of a location of a narrowest cross section of the venturi tube, the steam being introduced upstream of said location of fuels, residues and wastes introduction.

8. The method as claimed in claim 1, in which steam is added to the gasifying medium.

9. Apparatus for gasifying liquid fuels, residues and waste, comprising:

a gasification reactor, the gasification reactor including a gasification burner;

a prevaporization chamber upstream of the gasification reactor;

means for supplying a feed of the fuels, residues and waste into said prevaporization chamber;

means for supplying a feed of steam into said prevaporization chamber for completely vaporizing the liquid fuels, residues and waste to vapor form, said prevaporization chamber communicating with said gasification reactor so that the vapor form fuels, residues and waste, and the steam pass into the gasification reactor; and means for supplying a gasifying medium to said gasification reactor, the vapor form fuels, residues and wastes reacting with the gasifying medium in the gasification reactor to provide a gasified form of said fuels, residues and waste.

10. The apparatus as claimed in claim 9, in which the gasification burner includes an annular passage and a burner mouth at which said annular passage outlets, the vapor form fuels, residues and waste passing from the prevaporization chamber through said annular passage for outletting at said burner mouth at which the gasification reaction occurs; and a central tube in which the gasifying medium flows to the burner mouth.

11. The apparatus as claimed in claim 9, comprising a vessel, the prevaporization chamber and the gasification reactor being arranged in succession in-line in the vessel; and a common feed tube extending from an end of the vessel, the feed tube communicating with the prevaporization chamber, the feed of fuels, residues and waste, and the feed of steam being delivered to said prevaporization chamber through said common feed tube, the means for supplying gassifying medium being at least one pipe extending through the shell into the gasification reactor.

12. The apparatus as claimed in claim 9, in which the prevaporization chambers comprises a venturi tube, the means for supplying the feed of fuels, residues and waste being connected to the venturi tube upstream of a narrowest cross-section of said venturi tube, the means for supplying a feed of steam being connected to the venturi upstream of the connection of the means for supplying fuels, residues and waste.

13. Apparatus for gasifying liquid fuels, residues and waste, comprising:

a gasification reactor;

a gasification burner in the gasification reactor, the gasification burner having an inlet;

a heat exchanger, the heat exchanger having an inlet;

means for supplying a flow of liquid fuels, residues and waste to said heat exchanger inlet for flow passage thereof through the heat exchanger, said heat exchanger having an outlet;

means for supplying a flow of a heating medium through said heat exchanger in an indirect contact with said fuels, residues and waste to heat said fuels, residues and waste and completely vaporize said fuels, residues and wastes to vapor form;

means for connecting the heat exchanger outlet with the gasification burner inlet so that vapor from fuels, residues and waste flow to the gasification burner; and means for supplying a feed of gasification to the inlet of said gasification burner

14. The apparatus of claim 13, in which the heating medium is a feed of steam.

* * * * *